US006189192B1

(12) United States Patent
Baioff et al.

(10) Patent No.: US 6,189,192 B1
(45) Date of Patent: Feb. 20, 2001

(54) ELECTROSTATIC POWDER COATING SPRAY APPLICATOR TURBINE INSTALLATION/REMOVAL TOOL

(75) Inventors: Danny Baioff, Tecumseh; David A. Tiessen, Cottam; Gil Boucher, Tecumseh, all of (CA)

(73) Assignee: DaimlerChrysler Corporation, Auburn Hills, MI (US)

( * ) Notice: Under 35 U.S.C. 154(b), the term of this patent shall be extended for 0 days.

(21) Appl. No.: 09/394,761

(22) Filed: Sep. 13, 1999

(51) Int. Cl.[7] ..... B25B 27/14
(52) U.S. Cl. ..... 29/278; 29/280; 29/270
(58) Field of Search ..... 29/278, 280, 270, 29/239

(56) References Cited

U.S. PATENT DOCUMENTS 3,626,575 12/1971 Greenspan .
3,759,559 * 9/1973 Yuska ..... 29/278
3,867,753 2/1975 Urban, II et al. .
4,096,618 6/1978 Perline et al. .
4,202,088 * 5/1980 Hansen ..... 29/280
4,468,858 9/1984 Gulberg et al. .
5,097,581 3/1992 Williams et al. .

* cited by examiner

*Primary Examiner*—Robert C. Watson
(74) *Attorney, Agent, or Firm*—Lawrence J. Shurupoff

(57) ABSTRACT

A tool for installing and removing a turbine body and connected bell cup assembly into and out of a turbine body housing of a rotary powder coating electrostatic spray applicator is provided. The tool includes a first plate with an elongated aperture with a blind end. The first plate has a first surface for axial engagement with a radial surface of the turbine body. A second plate is connected with the first plate. The second plate has an elongated aperture with a blind end generally aligned with the elongated aperture of the first plate. The second plate has a first surface for axial engagement with the turbine body. The second plate also has a second surface generally opposite the first surface isolating the bell cup assembly from the turbine body. A handle is connected with the second plate.

8 Claims, 3 Drawing Sheets

10
54
50
52
92
60
70
80
56
18
14
94
96
20
48
12
44
46
49
34
38
42
40
36
22
37
57
59
27

44
11
104
44
44
48
13

ELECTROSTATIC POWDER COATING SPRAY APPLICATOR TURBINE INSTALLATION/REMOVAL TOOL

FIELD OF THE INVENTION

The field of the present invention relates to rotary powder coating electrostatic spray applicators. In particular, the present invention relates to a tool for a rotary powder coating electrostatic spray applicator for installing and removing a turbine body and connected bell cup assembly from a turbine body housing.

DESCRIPTION OF PRIOR DEVELOPMENTS

Automotive vehicles are typically covered with several different coating layers prior to being painted. One such coating is applied as a fine powder spray which is subsequently baked in a vehicle paint oven to form a strong substrate which resists chipping. The powder coating is applied under air pressure with a rotary sprayer known as a "bell." As a series of unpainted vehicle bodies pass through an enclosed room, electrically charged powder particles are discharged from a group of such bells in a mist or cloud. The vehicle body is also given an electrical charge. The electrical charge on the vehicle body attracts the electrical charged powder particles so that there is an even coating on the vehicle body.

The spray applicators have a turbine body housing which is connected with a pneumatic line and a powder coating delivery line. Within the turbine body housing is a member commonly referred to as a turbine body. The turbine body rotatively mounts an enclosed turbine. The turbine at a front end of the turbine body has a narrow section.

Connected to the narrow section of the turbine is a bell cup shaped as a truncated frustoconical member with its smaller diameter end being oriented toward the turbine body housing. The bell cup has its open end pointing toward the passing vehicles. Fluid and powder are delivered to the bell cup. Spaced from the bell cup is a cover.

The bell and bell cover are commonly referred to as the bell cup assembly. The cover essentially covers the opened end of the bell cup but is spaced away from the bell cup approximately 5–6 millimeters. The delivered powder coating proceeds through this spacing and into a truncated frustoconical air ring which directs it toward the vehicle.

Because of turbine failures, the turbine body and bell cup are removed for maintenance. In removing the turbine body and its connected bell cup, the turbine body and bell cup must be pulled axially outward from the turbine body housing. In an attempt to pull the turbine body out from the turbine body housing, a maintenance operator can inadvertently disturb the alignment of the bell cup upon the turbine body or affect the critical clearance between the bell cup cover and the bell cup. Damage to the critical clearance between the bell cup cover and the bell cup can cause the applicator to apply an uneven or marred coating upon the vehicle body.

The marred coating is typically not discovered until the vehicle leaves the paint oven or is observed down the assembly line. By the time the first improperly coated vehicle is discovered, approximately 40–60 vehicles will have similar defects. This will cause extensive repair effort to fix the vehicles. What is needed is a tool which can allow for the installation and removal of the turbine body, turbine and its connected bell cup assembly from and into the turbine body housing of the electrostatic powder coating applicator without damaging the alignment between the bell cup and the turbine body or disrupting the critical clearance between the bell cup and the bell cup cover.

SUMMARY OF THE INVENTION

The present invention has been developed to fulfill the need noted above. In the preferred embodiment the present invention provides a tool for installing and removing a turbine, turbine body and connected bell cup assembly of a rotary powder spray applicator into and out of a turbine body housing. The tool has a first plate with an elongated aperture or slot with a blind end. The first plate has a first surface for axial engagement with a radial surface of the turbine. A second plate is connected with the first plate. The second plate has an elongated aperture or slot with a blind end generally aligned with the elongated aperture of the first plate. The second plate has a first surface for axial engagement with the turbine body and a second surface opposite the first surface for isolating the bell cup from the turbine body. A handle is connected with the second plate.

It is an object of the present invention to provide a tool for installing and removing a turbine body and connected bell cup assembly from a rotary powder spray applicator turbine body housing. It is an object of the present invention to provide a tool which can install a turbine body and connected bell cup assembly without contacting the cover of the bell cup assembly. It is further an object of the present invention to provide a tool for installing and removing a turbine body and connected bell cup assembly from a rotary spray powder applicator turbine body housing without damaging the alignment of the bell cup with respect to the turbine body or the alignment and spacing of the bell cup cover with respect to the bell cup.

The above-noted objects of the present invention will become more apparent to those skilled in the art as the invention is further explained in the accompanying drawings and detailed description.

DETAILED DESCRIPTION OF THE DRAWINGS

Figure 1:
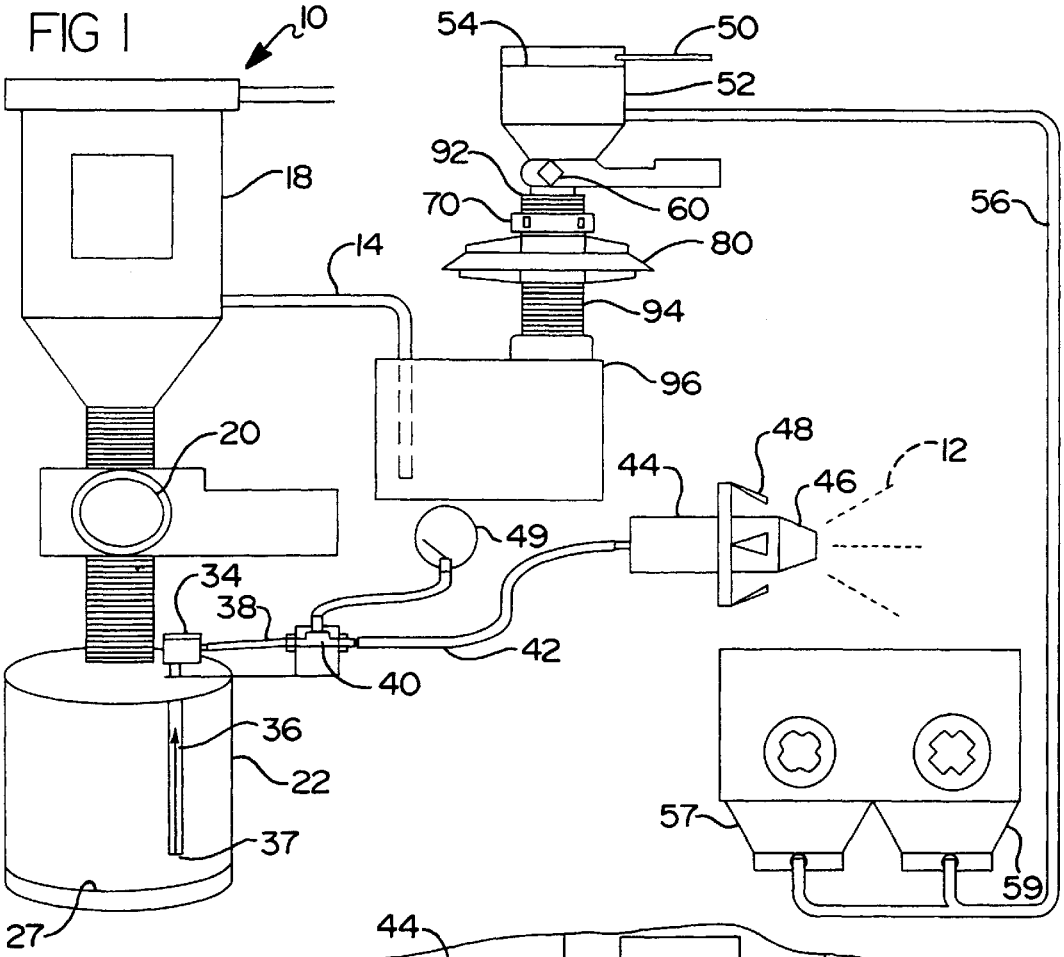
FIG. 1 is a schematic view with selected portions shown in perspective of an automotive vehicle paint powder system which utilizes a rotary powder coating electrostatic spray applicator in which a tool of the present invention is utilized.
Figure 2:
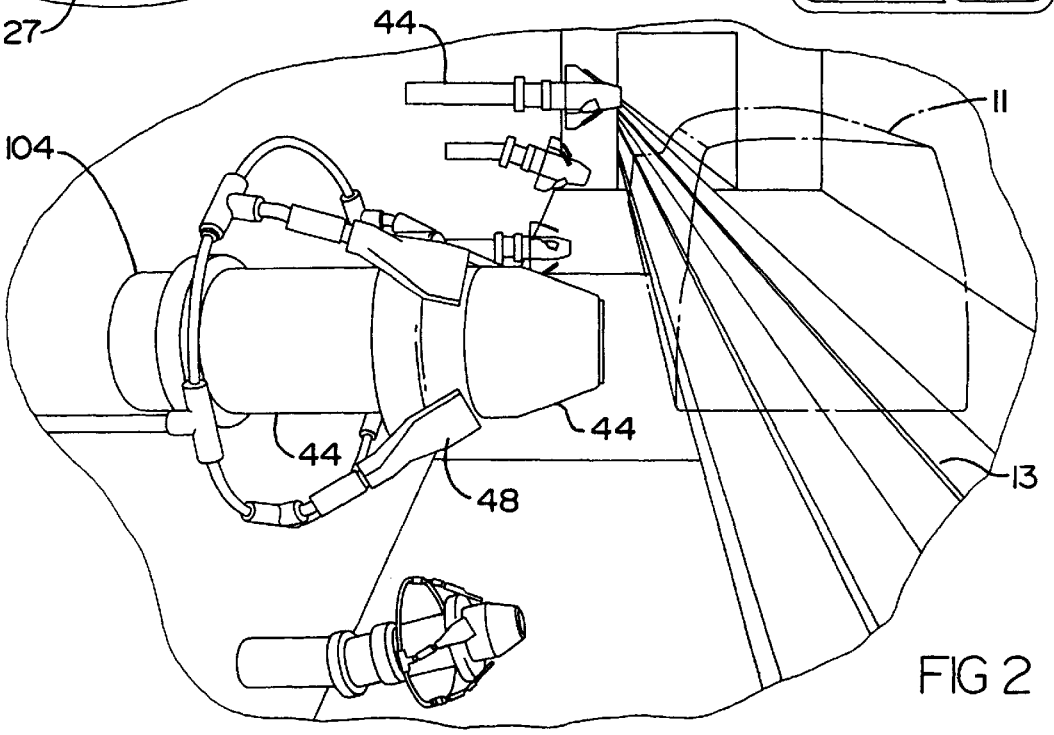
FIG. 2 is a perspective view of an assembly line with a multitude of rotary powder coating electrostatic spray applicators.

The present invention will be described in conjunction with the drawings, beginning with FIGS. 1 and 2 which show a rotary powder coating electrostatic spraying system 10 of the type used by vehicle manufacturers to coat automotive or truck bodies 11 with various protective coatings. In this particular example, a powder material 12 such as that used to form any chip-resistant coating prior to painting, is introduced through a conduit 14 and into a receiver 18.

A rotary paddle wheel 20 meters the powder material 12 from the receiver 18 into a fluidized bed chamber 22 while forming an airlock between the receiver 22 and the fluidized bed chamber 22. A rotating blade (not shown) driven by a motor produces a fluidized bed within the chamber 22 so as to produce a fluidized powder source in a known manner. A porous filter 27 serves as the base of the fluidized bed. An air pump (not shown) delivers pressurized air to a venturi pump 34. The above-noted air delivery creates a suction or drawing force in a draw pipe 36 which has an intake 37 suspended in the cloud or mist of the fluidized powder 12 in the chamber 22. The suction draws the powder through a pipe 36 and into an exhaust line 38.

The powder 12 is driven through the pressure line fitting 40 into a powder feed line 42. The pressurized fluidized powder material 12 is then driven into a conventional applicator 44. The applicator has a spinning head 46 (bell cup assembly) which distributes the powder in an electrically-charged cloud. Air nozzles 48 (FIG. 2) may be provided to prevent the powder from blowing back on the applicator 44. A pressure gauge 49 is used to monitor operation of the rotary powder coating electrostatic spraying system 10.

As mentioned previously, an electric charge is placed upon the paint particles 12 by the applicator 44. Additionally, the vehicle body 11 is electrically charged to aid in the coating process. However, some particles invariably do not adhere to the vehicle body 11 and therefore fall to the floor 13. The floor 13 is covered with grating, so that the fallen particles may be collected underneath and subsequently be recycled.

A vacuum line 50 is fluidly connected with the interior of a receiver 52. The receiver 52 along its upper interior has an air passing filter 54. The receiver 52 also has a powder delivery line 56 connected thereto. The vacuum line 50 induces the delivery of powder particles through the line 56 into the interior of the receiver 52. The powder particles delivered through line 56 can be exclusively recycled powder particles from a bin 57 or may be virgin powder particles from a recycling bin 59 or a selected combination thereof.

A rotary paddle wheel 60 meters the powder particles from receiver 52 into a large particle trap 70. In a manner similarly described for rotary paddle wheel 20, the rotary paddle wheel 60 provides an airlock between the receiver 52 and the large particle trap 70. The large particle trap 70 has an outlet which is connected to an inlet of a vibrator screen sleeve filter 80. The vibratory filter 80 is vibrated by a motor (not shown). The vibratory motor moves both the filter 80 and the large particle trap 70.

A flexible pipe connection 92 insulates the rotary paddle wheel 60 from the large particle trap 70. The sifted powder paint particles 12 after passing through a wire mesh sleeve of the vibrating filter 80 pass through an outlet 94 and become deposited within an interior of a bin 96. A venturi pump (not shown) delivers the paint particles 12 into the line 14 for delivery to the receiver 18.

Figure 3:
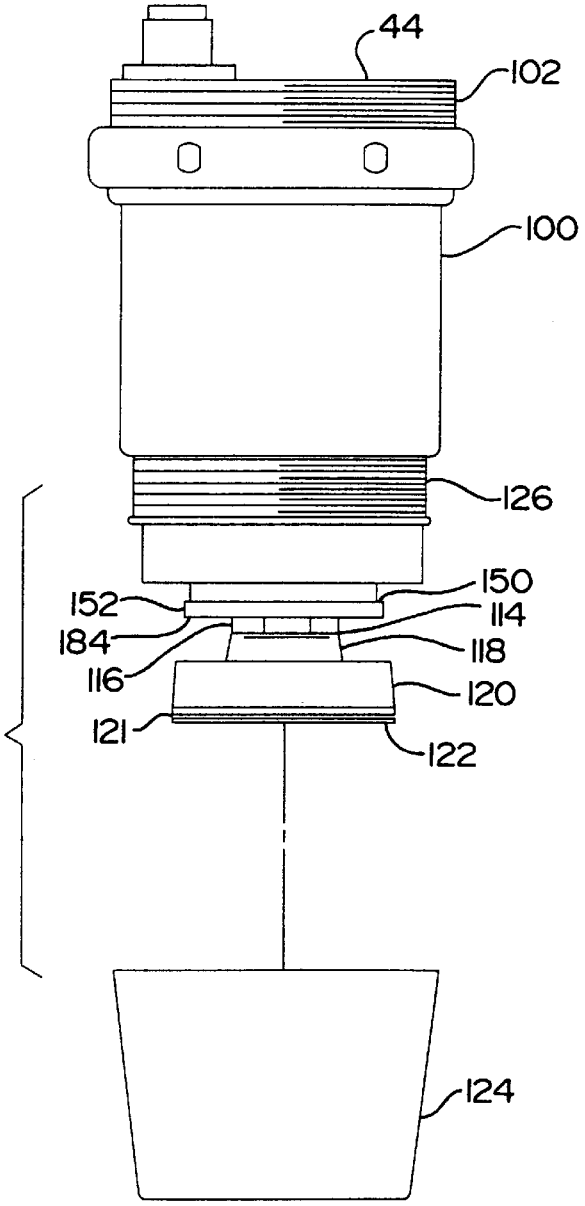
FIG. 3 is an exploded view of a rotary powder coating electrostatic spray applicator with the turbine body shown in the environment of a turbine body housing.
Figure 4:
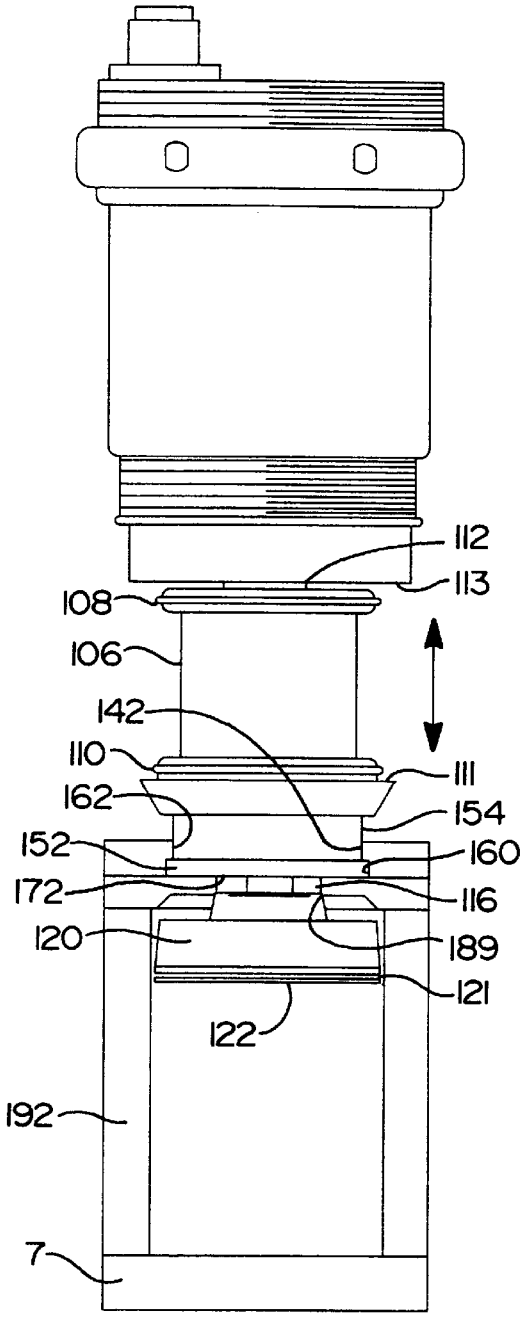
FIG. 4 is an operational view showing the installation and/or removal of a turbine body into a turbine body housing utilizing the inventive tool of the present invention.

Referring additionally to FIGS. 3 and 4, a rotary powder coating electrostatic spray applicator 44 is shown. The applicator as shown is model No. SRV-038, manufactured by Sames, of Franklin Park, Ill., a division of a French corporation. The applicator 44 has a stationary turbine body housing 100. The turbine body housing 100 at its rear end has a threaded portion 102 to allow it to be connected to a support or stand 104 as best shown in FIG. 2. A turbine body 106 is mounted within the turbine body housing 100. The turbine body 106 rotatively mounts a turbine within its interior. The turbine body 106 has a rear o-ring 108 and a forward o-ring 110. The turbine body has a location pin 111 which is aligned with an installation depression in a forward face 113 of the turbine body to insure proper radial alignment.

A rotative shaft 112 is rotatably mounted within the turbine body 106. The input shaft 112 is torsionally connected with the turbine (mounted within the turbine housing 106) and with a stub shaft 114. The stub shaft 114 has a rear portion 116 with a hex surface to allow it to be engaged by a wrench, and a forward section 118. The forward section 118 is connected with a bell cup assembly having a bell cup 120 and a bell cover 122. The bell cup 120 is a truncated frustoconical shape with a base oriented forwardly. Between the bell cup cover and the bell cup is an annular clearance gap 121 which is critical to be held in a range of 4–6 millimeters.

The powder coating is delivered through the annular clearance gap 121 between the bell cup cover 122 and the bell cup 120. The bell cup 120 is covered by a part referred to as a shaped air ring 124. The shaped air ring has a frustoconical shape, having its base orientated toward the turbine body housing 100 and is threadably connected onto the turbine body housing along a threaded section 126 of the turbine body housing. The shaped air ring 124 at its forward end has a series of apertures to allow the powder particles to shoot forward to coat the vehicle 11 (FIG. 2).

It is critical when either installing or removing the turbine body 106 and its connected bell cup 120 assembly, that the alignment between the bell cup 120 and turbine body 106 not be disturbed. It is additionally very critical that the clearance 121 between the bell cup 120 and the bell cup cover 122 not be disturbed in any manner. Failure to maintain the alignment between the various aforementioned parts can cause an uneven distribution of paint particles to be projected by the applicator 44, resulting in a marred paint finish upon the vehicle 11.

Figure 5:
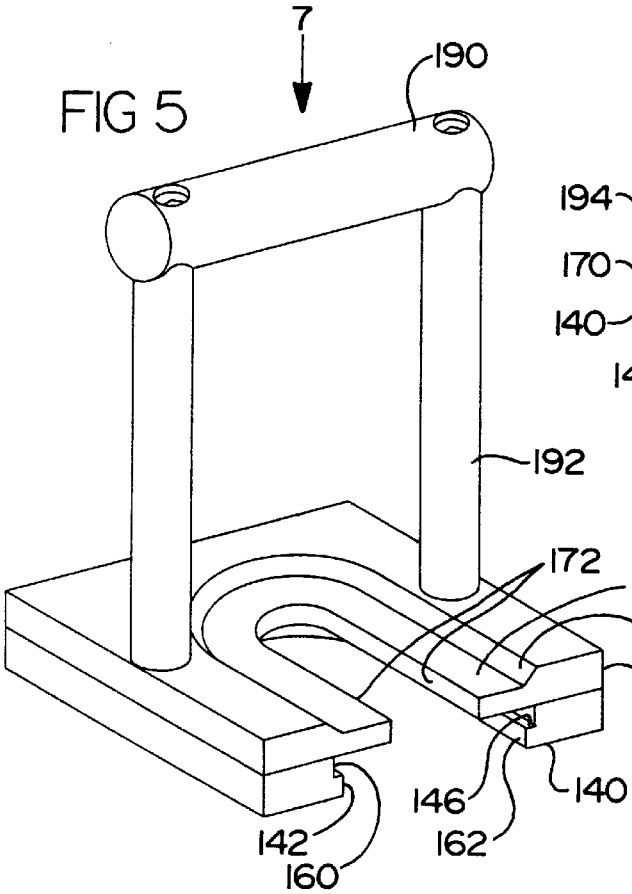
FIG. 5 is a perspective view of the tool according to the present invention.
Figure 6:
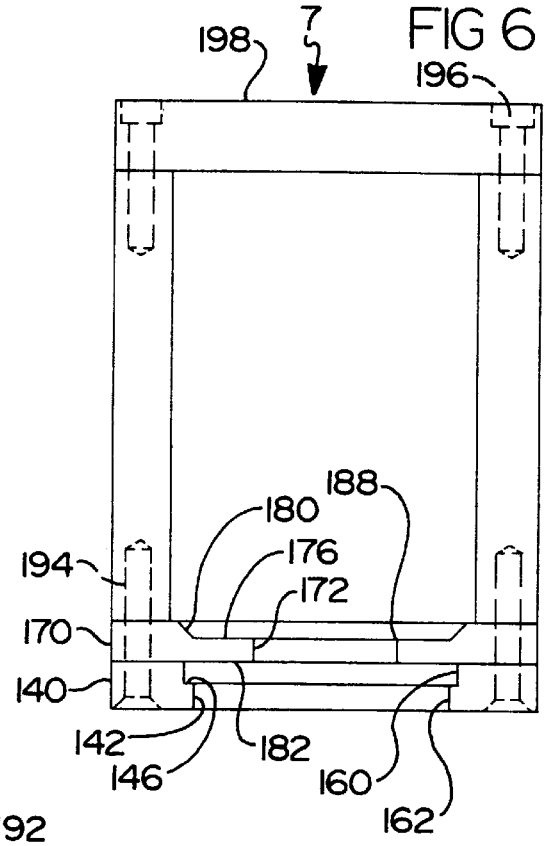
FIG. 6 is a front elevational view of the present invention.
Figure 7:
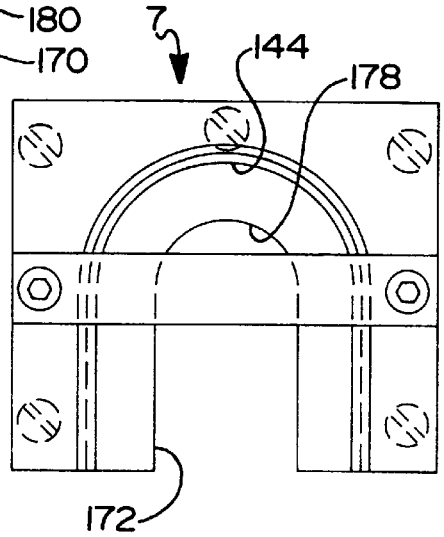
FIG. 7 is a top elevational view of the tool according to the present invention.

To install the turbine body 106 and its connected bell cup 120 there is provided an installation tool 7 as shown in FIGS. 5, 6 and 7. The installation tool 7 has a first plate 140. The first plate 140 has an elongated slot or aperture 142 with a radiused blind end 144. The first plate aperture 140 also has a shoulder 146. The shoulder 146 provides a first surface for axial engagement with a radial surface 150 (FIG. 3) of a radial projective rim surface 152 provided on the turbine body. A lateral surface 160 of the first plate 140 provides radial stabilization for the turbine body along the blind end 144. The lateral surface 160 stabilizes the turbine body 100 along the radial rim 150. Lateral surface 162 which is of a smaller width and diameter than surface 160 stabilizes the turbine body along radial or circumferential surface 154 as best shown in FIG. 4. Accordingly, the turbine body 106 has radial stabilization in two separate areas.

Connected adjacent to the first plate 140 is a second plate 170. The second plate has a second elongated aperture 172 which is generally aligned symmetrically with the first aperture 142. Typically, the second aperture 172 has a smaller width than the first aperture 142. The aperture 172 has an adjacent expanded grooved region 176 which blends into a tapered portion 180. The second plate 170 has a first surface 182 for axial engagement with the axial forward surface 184 (FIG. 3) of the radial rim 152. The second plate

170 also has a second surface provided by the grooved region 176 which isolates the bell cup 120 from the turbine body 106. A radiused blind end 178 of the second aperture provides lateral support to the stub shaft rear portion 116. The grooved region 176 and the tapered portion 180 are generated to allow clearance for the bell cup 120 when the tool 7 is utilized to install or remove the bell cup 120 and its connected turbine body 106 into the turbine body housing 100.

Connected with the second plate 170 is a handle 190. The handle 190, like the first and second plates, is made from a polymeric material, typically a plastic. The handle has two uprights 192. The uprights or shafts 192 are joined to the second plate 170 by threaded fasteners such as screws 194 which additionally also connect the first plate 140 with the second plate 170. Screws 196 connect a crossbeam 198 to the two uprights 192. The crossbeam 198 is spaced away from the second plate 170 such that a human operator can easily pass a hand through the handle without contacting the bell cup 120.

In operation, the air ring 124 is screwed off the turbine housing 100. The installation removal tool 7 is positioned such that the stub shaft 116 is aligned with the aperture 172 in the second plate and the radial rim 152 of the turbine body is placed within the aperture 142 of the first plate.

After the operator has manipulated tool 7 such that the turbine body 106 is abutting the blind end of the apertures 142, 172 in the first and second plates, the operator can then use the handle 7 to pull the turbine body 106 axially out of the turbine body housing 100. Installation of the turbine body 106 and the connected bell cup 120 is achieved by a reversal of the above-noted procedures. The bell cup 120 is protected and is held in its position with respect to the turbine body 106 at all times without any loading being applied by the tool 7. The bell cup cover 122 is not disturbed in either the installation or the removal operation.

While the present invention was illustrated and described with respect to various preferred embodiments, such descriptions are exemplary only and not limiting in nature. It is well understood by those skilled in the art that various changes and modifications can be made in the invention without departing from the spirit and scope thereof, which is limited only by the appended claims.

We claim:

1. A tool for installing and removing a turbine body and connected bell cup assembly into and out of a turbine body housing of a rotary spray applicator comprising:

a first plate with an elongated aperture with a blind end, said first plate having a first surface for axial engagement with a radial surface of said turbine body;

a second plate connected with said first plate with an elongated aperture with a blind end generally aligned with said elongated aperture of said first plate, said second plate having a first surface for axial engagement with said turbine body and said second plate having a second surface generally opposite said first surface isolating said bell cup assembly from said turbine body; and a handle connected with said second plate.

2. A tool as described in claim 1 wherein said handle is large enough for a human hand to grab said handle and to be spaced away from said second plate.

3. A tool as described in claim 1 wherein said first plate aperture is shouldered.

4. A tool as described in claim 1 wherein said second plate aperture has a width smaller than said first plate aperture.

5. A tool as described in claim 1 wherein said second plate has a tapered groove adjacent said aperture.

6. A tool as described in claim 1 wherein said tool is made from a polymeric substance.

7. A tool as described in claim 1 wherein said first and second plates and said handle are connected to one another by a common fastener.

8. A tool for installing and removing a turbine body and connected bell cup assembly into and out of a turbine bell housing of a rotary powder coating electrostatic spray applicator comprising:

a first plate with an elongated shouldered aperture with a radiused blind end, said first plate aperture shoulder providing a surface for axial engagement with a radial rim of said turbine body and said radiused end of said first plate aperture also providing radial alignment surfaces for engagement with first and second radial surfaces of said turbine body;

a second plate connected with said first plate by a threaded fastener, said second plate having an elongated aperture with a radiused end, and said second aperture having a first width portion smaller than the width of said first elongated aperture and said second plate having a first surface for axial engagement with said turbine body, and said second plate having a second surface generally opposite said first surface having a tapered grooved portion isolating said bell cup assembly from said turbine body; and a handle connected with said second plate via said threaded fastener connecting said second plate with said first plate.

* * * * *